US008371912B2

(12) United States Patent
Ozeki

(10) Patent No.: US 8,371,912 B2
(45) Date of Patent: Feb. 12, 2013

(54) UNIT TYPE CLEAN ROOM

(75) Inventor: Kazuhiro Ozeki, Shimotsuma (JP)

(73) Assignee: Unitec Inc., Shimotsuma-shi (JP)

( * ) Notice: Subject to any disclaimer, the term of this patent is extended or adjusted under 35 U.S.C. 154(b) by 453 days.

(21) Appl. No.: 12/646,147

(22) Filed: Dec. 23, 2009

(65) Prior Publication Data

US 2010/0112926 A1 May 6, 2010

Related U.S. Application Data

(63) Continuation of application No. PCT/JP2008/060927, filed on Jun. 10, 2008.

(30) Foreign Application Priority Data

Jun. 25, 2007 (JP) ..... 2007-166678

(51) Int. Cl.
*B01L 1/04* (2006.01)

(52) U.S. Cl. ..... 454/187

(58) Field of Classification Search ..... 454/187–193
See application file for complete search history.

(56) References Cited

U.S. PATENT DOCUMENTS

| | | | | | |
|---|---|---|---|---|---|
| 3,115,819 | A | * | 12/1963 | Mahlmeister et al. | 454/187 |
| 3,158,457 | A | * | 11/1964 | Whitfield | 55/472 |
| 4,267,769 | A | * | 5/1981 | Davis et al. | 454/187 |
| 4,304,224 | A | * | 12/1981 | Fortney | 600/21 |
| 4,409,889 | A | * | 10/1983 | Burleson | 454/187 |
| 4,549,472 | A | * | 10/1985 | Endo et al. | 454/187 |
| 4,554,766 | A | * | 11/1985 | Ziemer et al. | 52/28 |
| 4,667,579 | A | * | 5/1987 | Daw | 454/187 |
| 4,667,580 | A | * | 5/1987 | Wetzel | 454/187 |
| 4,693,175 | A | * | 9/1987 | Hashimoto | 454/187 |
| 4,694,736 | A | * | 9/1987 | Yamagata et al. | 454/187 |
| 4,967,645 | A | * | 11/1990 | Mattson | 454/296 |
| 5,029,518 | A | * | 7/1991 | Austin | 454/187 |
| 5,167,575 | A | * | 12/1992 | MacDonald | 454/187 |
| 5,256,105 | A | * | 10/1993 | Austin | 454/187 |
| 5,259,812 | A | * | 11/1993 | Kleinsek | 454/57 |
| 5,365,013 | A | * | 11/1994 | Aulson | 588/249 |
| 5,507,122 | A | * | 4/1996 | Aulson | 52/79.1 |
| 5,511,594 | A | * | 4/1996 | Brennan et al. | 141/98 |
| 5,752,985 | A | * | 5/1998 | Nagafune et al. | 29/25.01 |
| 6,033,301 | A | * | 3/2000 | Suwa | 454/187 |
| 6,082,149 | A | * | 7/2000 | Woods | 68/17 R |
| 6,174,341 | B1 | * | 1/2001 | Burge | 55/385.2 |

(Continued)

FOREIGN PATENT DOCUMENTS

| | | | |
|---|---|---|---|
| JP | 61-101733 | A | 5/1986 |
| JP | 61101733 | A * | 5/1986 |

(Continued)

*Primary Examiner* — Steven B McAllister
*Assistant Examiner* — Jamil Decker
(74) *Attorney, Agent, or Firm* — Westerman, Hattori, Daniels & Adrian, LLP

(57) ABSTRACT

A unit type clean room has a wide operation space while providing a high air cleaning effect, is unitized and can be easily installed. The unit type clean room is characterized by including: a machine room unit; a front room unit; and a clean room unit, wherein an air conditioner and a fixed air volume device are installed in the machine room unit, the air conditioner is connected to two HEPA filter units installed in the clean room unit via an air duct, the fixed air volume device is connected to a return air chamber installed in the clean room unit via a return air duct to circulate purified air, purified air is always retained in the clean room, and a front room and an air shower are placed in the front room unit.

2 Claims, 17 Drawing Sheets

U.S. PATENT DOCUMENTS

| | | | | |
|---|---|---|---|---|
| 6,306,189 | B1 * | 10/2001 | Renz | 55/385.2 |
| 6,347,990 | B1 * | 2/2002 | Sung et al. | 454/187 |
| 6,368,208 | B1 * | 4/2002 | Minoshima | 454/187 |
| 6,394,523 | B1 * | 5/2002 | Yoo et al. | 296/24.32 |
| 6,405,491 | B1 * | 6/2002 | Gallant | 52/36.1 |
| 6,482,083 | B1 * | 11/2002 | Nilsson | 454/187 |
| 6,602,128 | B1 * | 8/2003 | Spengler | 454/187 |
| 6,869,457 | B2 * | 3/2005 | Nakagawa | 55/385.2 |
| 6,881,685 | B2 * | 4/2005 | Suenaga et al. | 438/795 |
| 7,022,009 | B2 * | 4/2006 | Kim | 454/187 |
| 7,247,090 | B2 * | 7/2007 | Vacek | 454/186 |
| 7,285,147 | B2 * | 10/2007 | Kuo et al. | 55/385.2 |
| 7,323,025 | B2 * | 1/2008 | Weidner | 55/385.2 |
| 7,465,225 | B2 * | 12/2008 | Ohmura et al. | 454/187 |
| 7,527,664 | B2 * | 5/2009 | Jackson | 55/385.2 |
| 7,925,390 | B2 * | 4/2011 | Jingu et al. | 700/301 |
| 7,985,382 | B1 * | 7/2011 | Henry et al. | 422/291 |
| 8,096,862 | B1 * | 1/2012 | Demster | 454/237 |
| 2003/0038929 | A1 * | 2/2003 | Tokuda et al. | 355/30 |
| 2003/0045226 | A1 * | 3/2003 | Yokoyama et al. | 454/187 |
| 2003/0050005 | A1 * | 3/2003 | Nakao | 454/187 |
| 2003/0138344 | A1 * | 7/2003 | Mielnik et al. | 422/2 |
| 2003/0167740 | A1 * | 9/2003 | Murphy | 55/337 |
| 2004/0003581 | A1 * | 1/2004 | Lim et al. | 55/385.2 |
| 2004/0029521 | A1 * | 2/2004 | Cauthorne | 454/229 |
| 2004/0147214 | A1 * | 7/2004 | Oono | 454/187 |
| 2006/0107635 | A1 * | 5/2006 | Homan et al. | 55/385.2 |
| 2006/0217056 | A1 * | 9/2006 | Gomi et al. | 454/187 |
| 2007/0066205 | A1 * | 3/2007 | Ohmura et al. | 454/66 |
| 2007/0190922 | A1 * | 8/2007 | Fuchs et al. | 454/187 |
| 2010/0022179 | A1 * | 1/2010 | Uematsu et al. | 454/187 |
| 2010/0112926 | A1 * | 5/2010 | Ozeki | 454/187 |
| 2010/0304658 | A1 * | 12/2010 | Grcevic | 454/187 |
| 2011/0053486 | A1 * | 3/2011 | Holtz et al. | 454/187 |
| 2011/0217917 | A1 * | 9/2011 | Sulva | 454/187 |
| 2011/0219953 | A1 * | 9/2011 | Schreiber | 95/273 |

FOREIGN PATENT DOCUMENTS

| | | | | |
|---|---|---|---|---|
| JP | 05288378 | A | * | 11/1993 |
| JP | 05299312 | A | * | 11/1993 |
| JP | 06066432 | A | * | 3/1994 |
| JP | 06159751 | A | * | 6/1994 |
| JP | 6-272921 | A | | 9/1994 |
| JP | 06272921 | A | * | 9/1994 |
| JP | 2001-133001 | A | | 5/2001 |
| JP | 2001133001 | A | * | 5/2001 |
| JP | 2001254979 | A | * | 9/2001 |
| JP | 2003-083578 | A | | 3/2003 |
| JP | 2003083578 | A | * | 3/2003 |
| JP | 2007303165 | A | * | 11/2007 |

* cited by examiner

UNIT TYPE CLEAN ROOM

CROSS-REFERENCE TO RELATED APPLICATIONS

The present application is a continuation application of International Application No. PCT/JP2008/60927, filed Jun. 10, 2008, which claims priority to Japanese Patent Application No. 2007-166678, filed Jun. 25, 2007. The contents of these applications are incorporated herein by reference in their entirety.

BACKGROUND OF THE INVENTION

1. Technical Field

The present invention relates to a unit type clean room.

2. Background Art

Conventionally, installing a clean room by newly building or rebuilding requires large equipment, and the clean room cannot be easily installed because of problems such as high costs or an installation location.

To solve such problems, a clean booth unit and a clean room including the same described in Japanese Unexamined Patent Application Publication No. 6-272921 has been proposed as a clean room that can be installed at low costs without requiring much load of equipment.

However, the clean booth unit and a clean room including the same have a configuration in which a plurality of small clean booth units are arranged along an assembly line in the clean room and adjacent clean booth units successively suck air in the assembly of accurate instruments, and when many operators and operation steps are required, many clean booth units are required. Thus, although the costs of only one clean booth unit are low, requiring many clean booth units may finally cost high.

SUMMARY OF THE INVENTION

Thus, the present invention has an object to provide a clean room that is unitized and can be easily installed, can be increased or decreased in floor area, can freely combine units that constitute the clean room, and maintains a wide operation space while providing a high air cleaning effect.

To achieve the above-described object, the present invention provides a unit type clean room 1 characterized by including: a machine room unit 2 in which an air conditioner 5 and a fixed air volume device 5*a* are installed; a clean room unit 10 in which two HEPA filter units 12 and 12*a* connected to the air conditioner 5 via an air duct 13 are installed, and a return air chamber 15 connected to the fixed air volume device 5*a* via a return air duct 14 is installed; and a front room unit 6 in which an air shower 9 that removes dust 20*a* before entering the clean room unit 10 is installed.

DESCRIPTION OF THE EMBODIMENTS

A unit type clean room according to the present invention is a unit type clean room that includes a machine room unit, a front room unit, and a clean room unit, and in which an air conditioner and a fixed air volume device installed in the machine room unit are connected to HEPA filter units installed in the clean room unit via an air duct and a return air duct to circulate air, and thus clean air can be always retained in the clean room that is an operation space.

Figure 1:
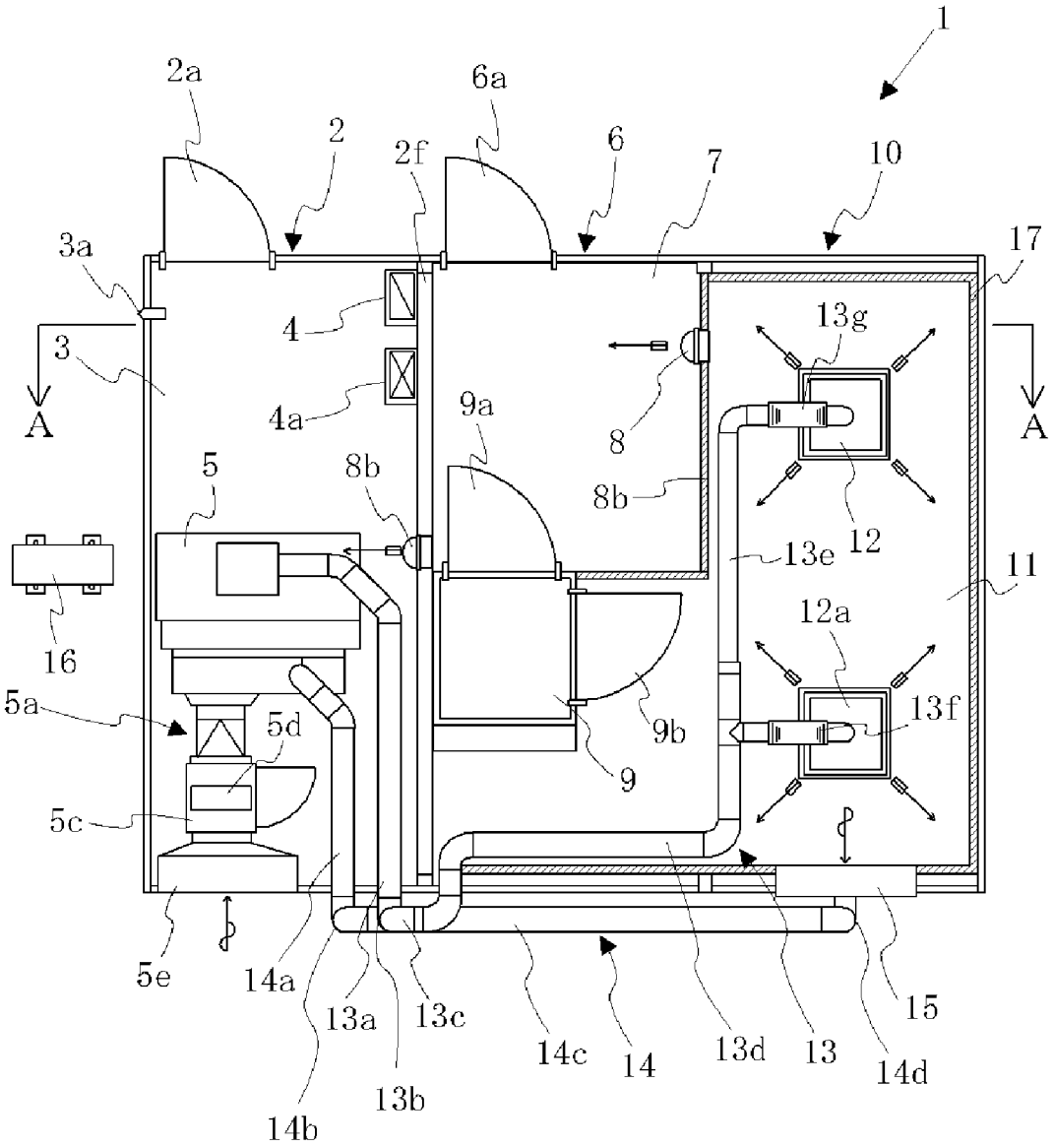
FIG. 1 is a plan view of a unit type clean room according to the present invention.

FIG. 1 is a plan view of a unit type clean room according to the present invention. As shown in FIG. 1, the unit type clean room 1 according to the present invention includes a machine room unit 2, a front room unit 6, and a clean room unit 10, an air duct 13 connected to an air conditioner 5 installed in the machine room unit 2 is connected to HEPA filter units 12 and 12*a* installed in the clean room unit 10, and a return air duct 14 connected to a fixed air volume device 5*a* installed in the machine room unit 2 is connected to a return air chamber 15 installed in the clean room unit 10.

Figure 2:
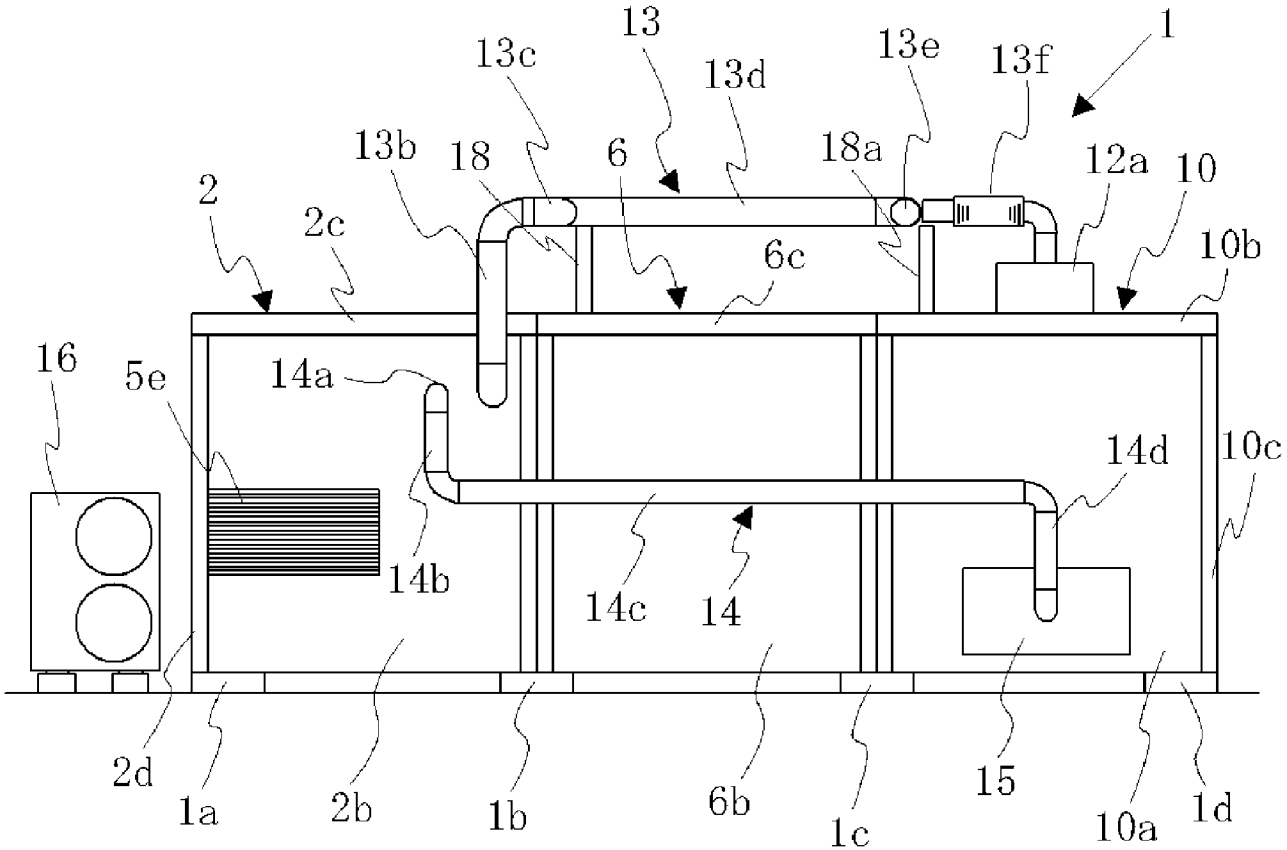
FIG. 2 is a front view of the unit type clean room according to the present invention.
Figure 3:
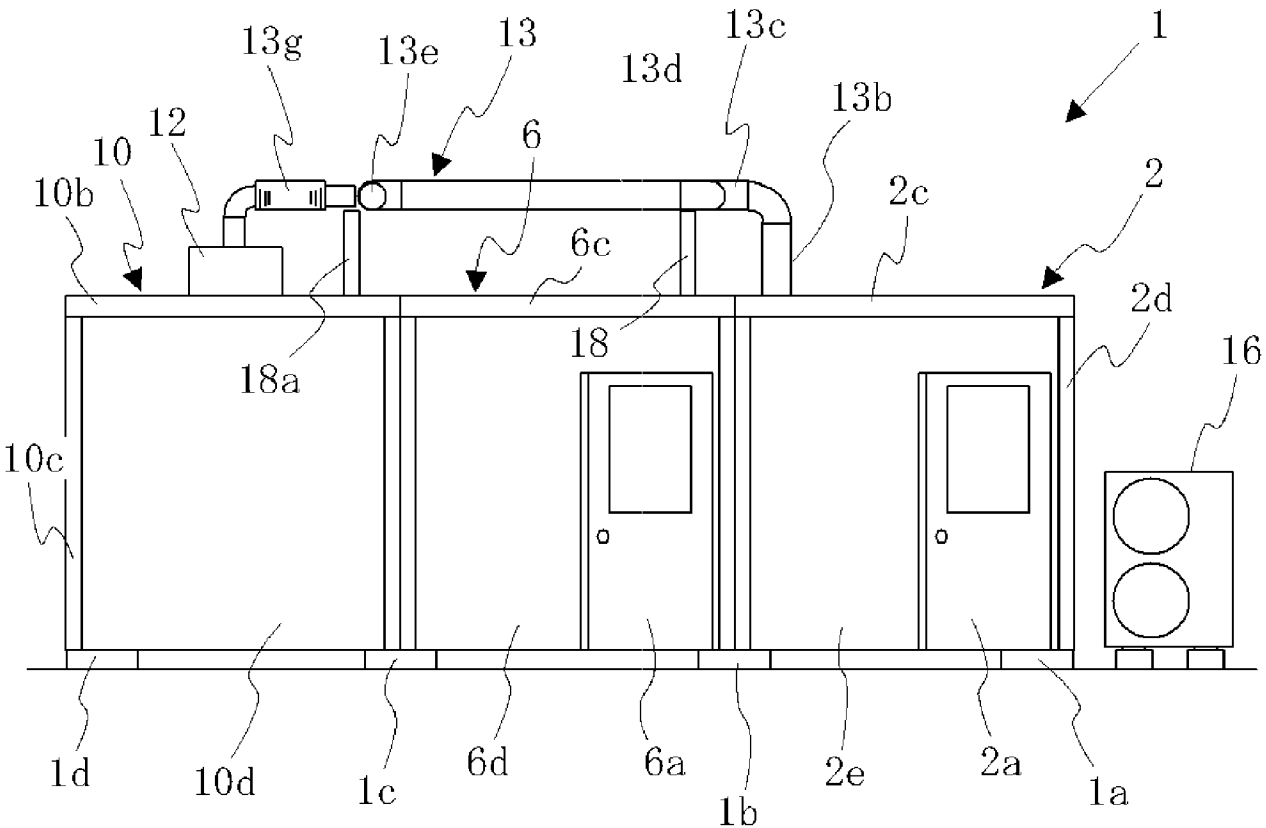
FIG. 3 is a back view of the unit type clean room according to the present invention.
Figure 4:
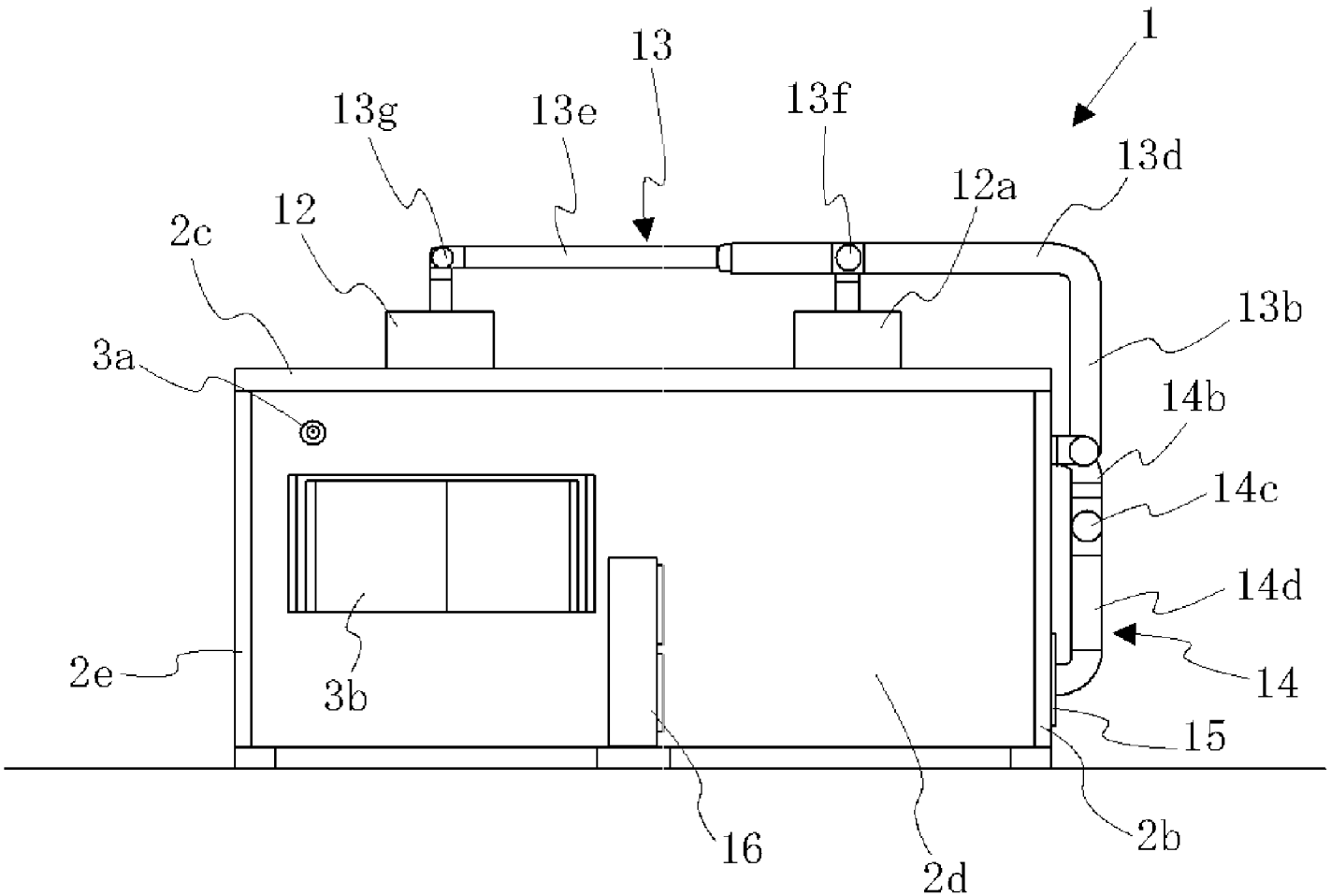
FIG. 4 is a left side view of the unit type clean room according to the present invention.
Figure 5:
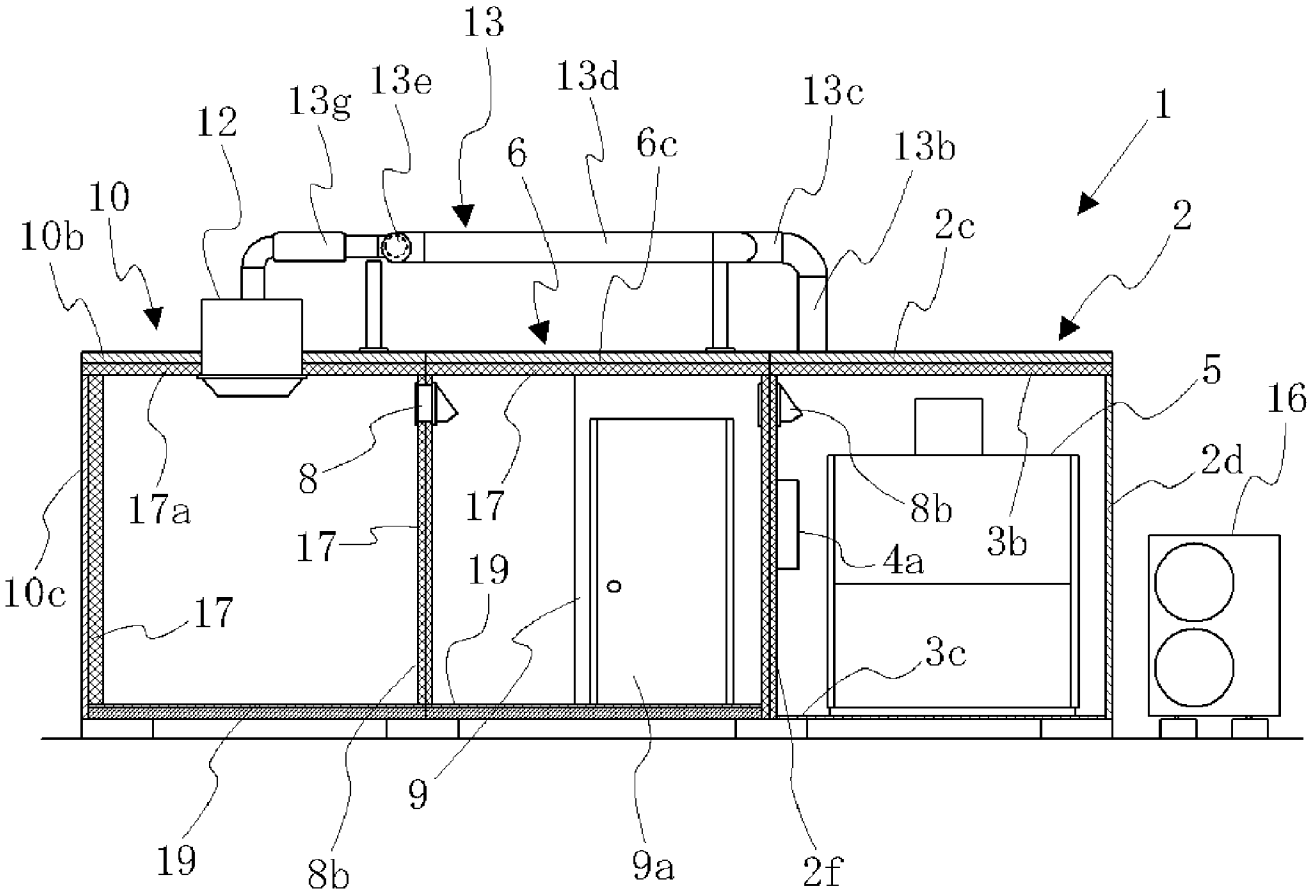
FIG. 5 is an A-A sectional view of the unit type clean room according to the present invention.

FIGS. 2 to 4 show an appearance of the unit type clean room according to the present invention shown in FIG. 1. Specifically, FIG. 2 is a front view of the unit type clean room according to the present invention, FIG. 3 is a back view of the unit type clean room according to the present invention, FIG. 4 is a left side view of the unit type clean room according to the present invention, and FIG. 5 is a sectional view taken along the line A-A in FIG. 1.

As shown in FIG. 2, the air duct 13 and the return air duct 14 that connect the machine room unit 2 and the clean room unit 10 are placed on the front of the unit type clean room 1. The unit type clean room 1 is supported by bases 1*a* to 1*d*.

As shown in FIG. 3, a machine room inlet door 2*a* into a machine room 3 is provided on the back of the machine room unit 2 that constitutes the unit type clean room 1, and a front room inlet door 6*a* into a front room 7 is provided on the back of the front room unit 6.

On the outside of the unit type clean room 1, an outdoor unit 16 is installed outside the machine room unit 2.

As shown in the A-A sectional view in FIG. 5, in the front room unit 6, a door of an air shower inlet 9*a* into an air shower 9 is provided immediately inside the front room inlet door 6*a*. Also, differential pressure dampers 8 and 8*a* are mounted to a boundary panel 2*f* that connects the machine room unit 2 and the front room unit 6 and a boundary panel 8*b* that connects the front room unit 6 and the clean room unit 10, respectively.

A shown in FIG. 5, a machine room ceiling panel 3*b* of the machine room unit 2, the boundary panel 2*f*, a ceiling and a wall of the front room unit 6, and a ceiling and a wall of the clean room unit 10 are formed of heat insulating panels 17 and 17*a*. The front room unit 6 and the clean room unit 10 are formed of flooring 19.

Now, the machine room unit 2, the clean room unit 10, and the front room unit 6 that constitute the unit type clean room 1 will be individually described in detail.

Figure 6:
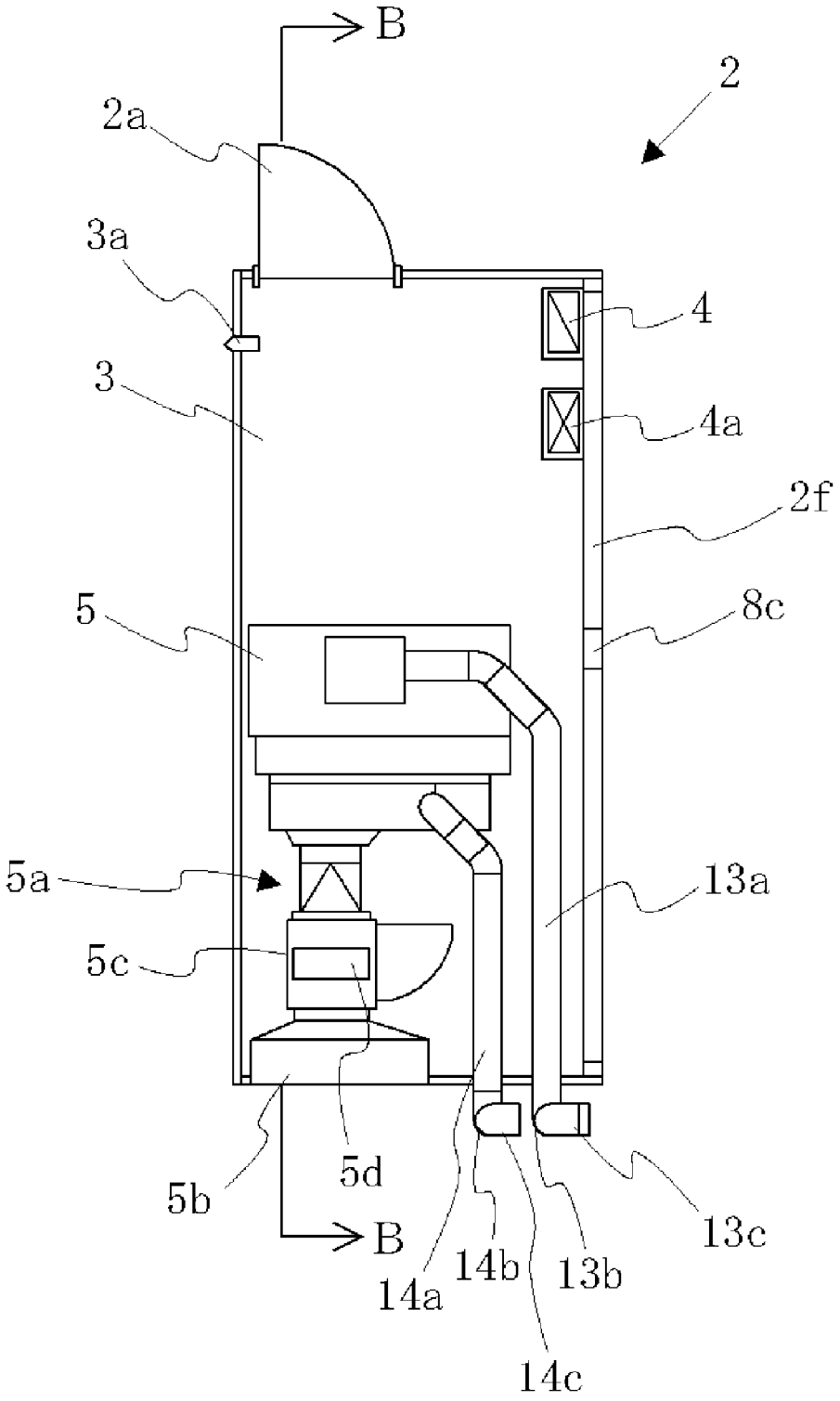
FIG. 6 is a plan view of a machine room unit that constitutes the unit type clean room according to the present invention.
Figure 7:
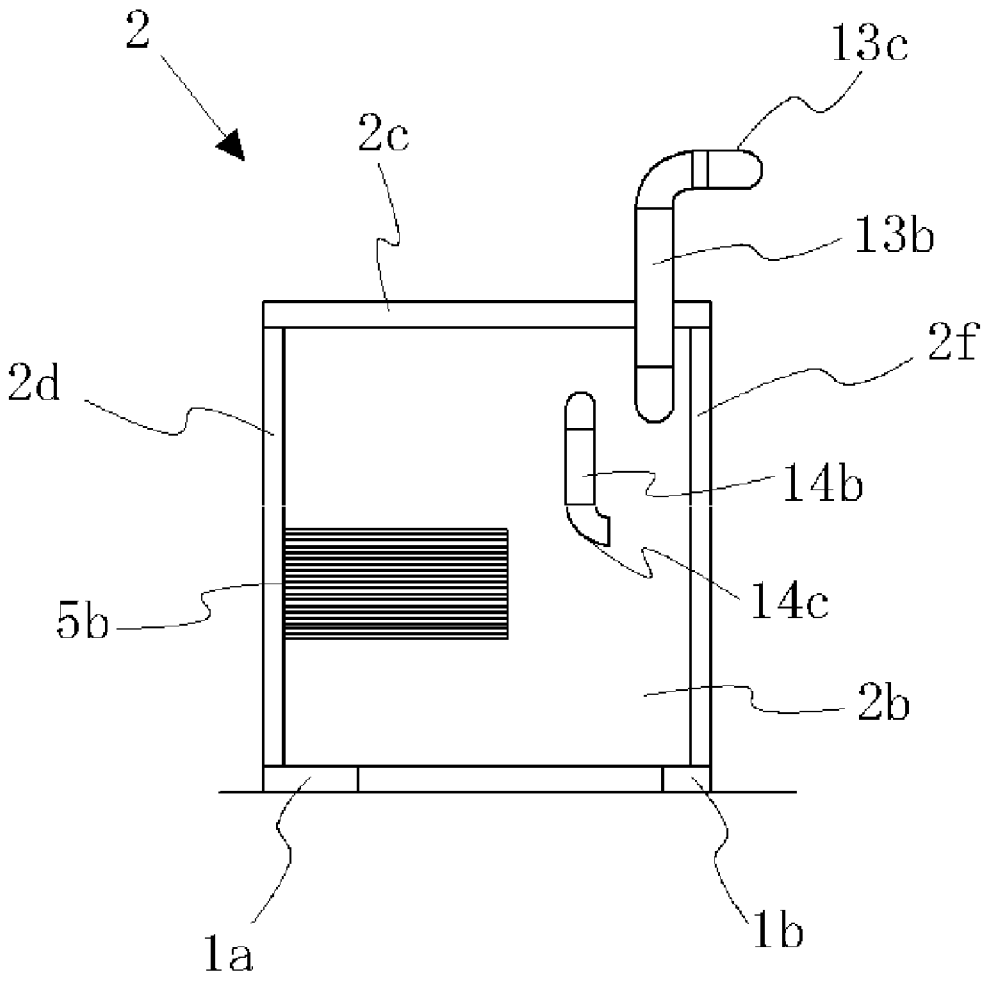
FIG. 7 is a front view of the machine room unit that constitutes the unit type clean room according to the present invention.
Figure 8:
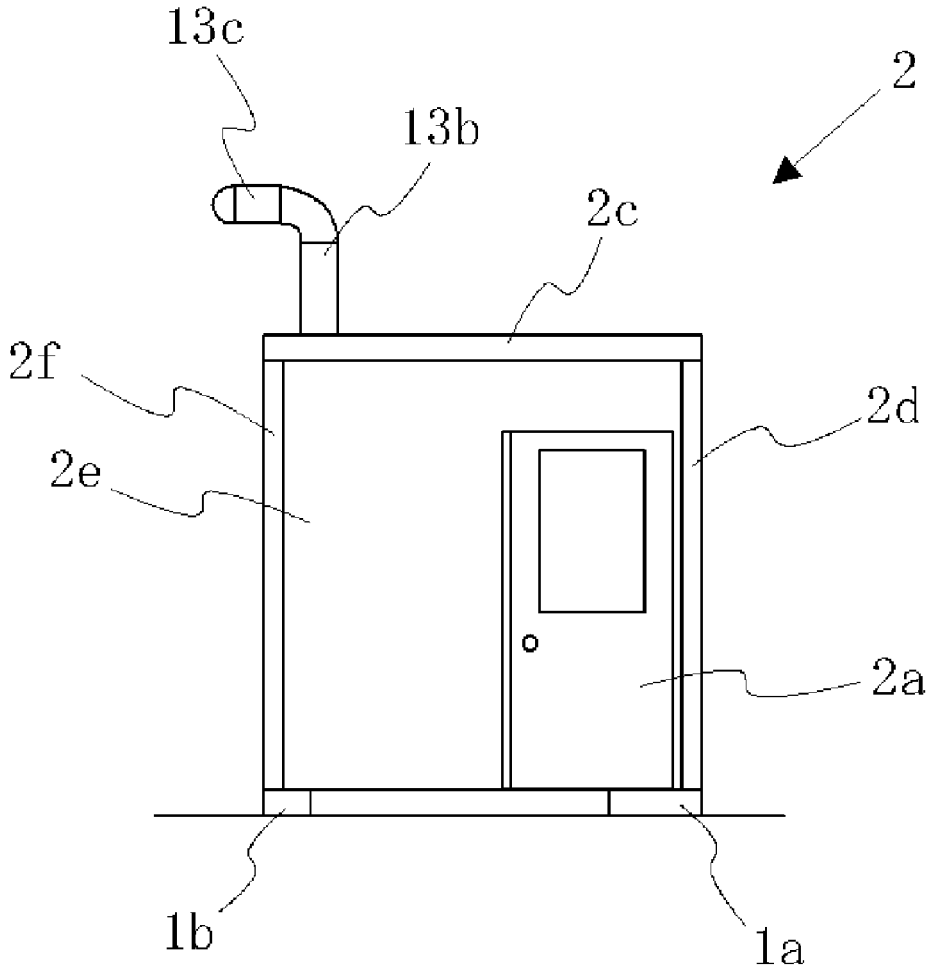
FIG. 8 is a back view of the machine room unit that constitutes the unit type clean room according to the present invention.
Figure 9:
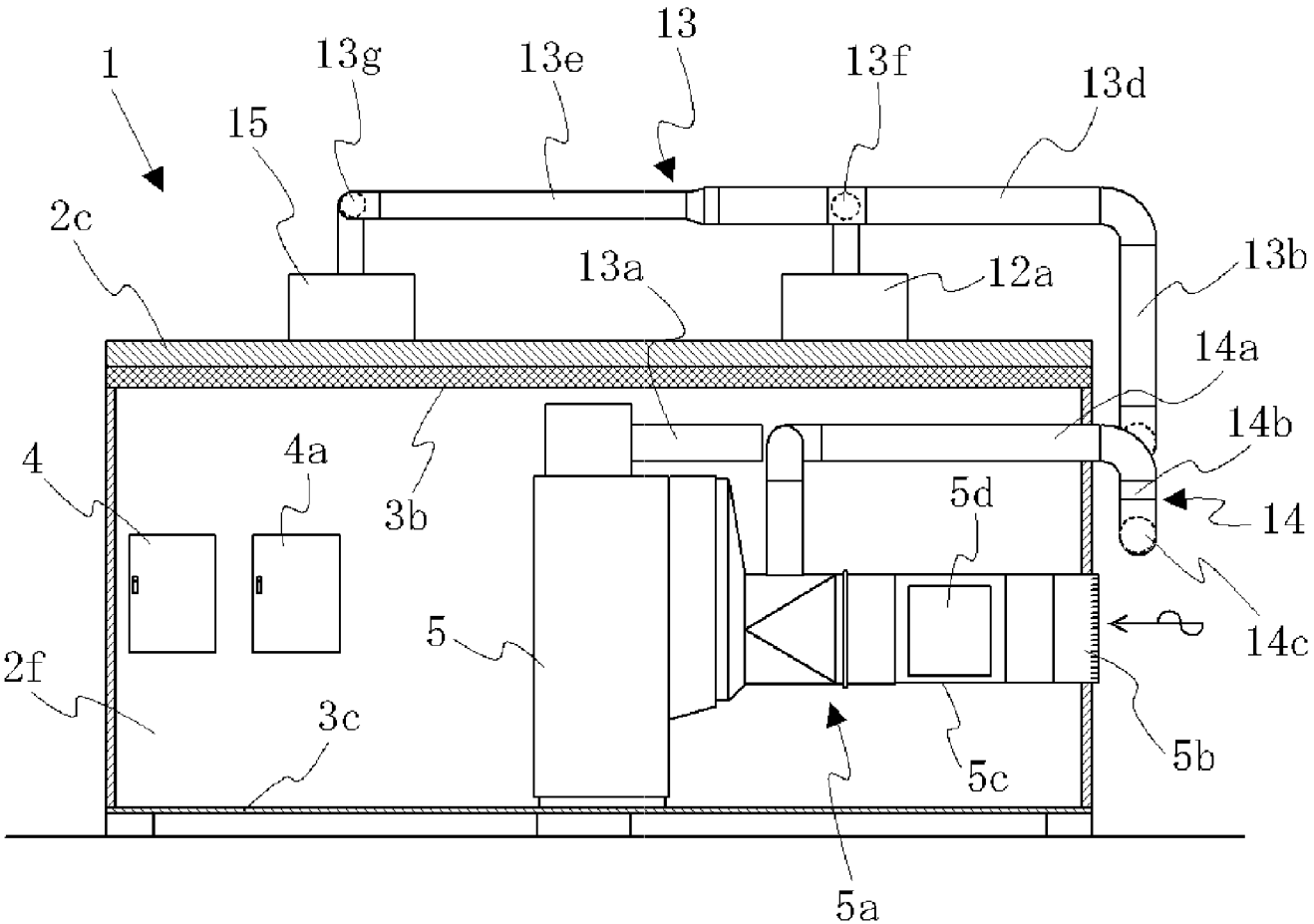
FIG. 9 is a B-B sectional view of the machine room unit that constitutes the unit type clean room according to the present invention.

FIGS. 6 to 9 show the machine room unit that constitutes a unit type clean room according to the present invention. FIG. 6 is a plan view of the machine room unit, FIG. 7 is a front view of the machine room unit, FIG. 8 is a back view of the machine room unit, and FIG. 9 is a sectional view of the machine room unit taken along the line B-B in FIG. 6.

As shown in FIGS. 6 to 9, the machine room unit 2 that constitutes the unit type clean room 1 according to the present invention constitutes a rectangular parallelepiped machine room 3 surrounded by a machine room front panel 2*b*, a machine room roof panel 2*c*, a machine room outer wall panel 2*d*, a machine room back panel 2*e*, the boundary panel 2*f*, and flooring 3*c*. In this case, the machine room ceiling panel 3*b* that constitutes a ceiling of the machine room 3 is formed of an insulating material. A vent cap 3*a* is provided in the machine room outer wall panel 2*d*.

A machine room inlet door 2*a* is provided in the machine room back panel 2*e*, and a power board 4 and a control board 4*a* are mounted to a wall surface immediately inside the machine room inlet door 2*a*, that is, the boundary panel 2*f*. The power board 4 and the control board 4*a* are used for operating the entire unit type clean room 1 according to the present invention.

An air conditioner 5 is installed in the middle of the machine room 3, and a fixed air volume device 5*a* is connected to the air conditioner 5. The fixed air volume device 5*a* includes an outside air filter unit 5*c*, and a front end of the outside air filter unit 5*c* is connected to an air inlet 5*b* provided in the machine room front panel 2*b*.

The air duct 13 is connected to an upper portion of the air conditioner 5 provided in the machine room 3, and the return air duct 14 is connected to the fixed air volume device 5*a*. In the fixed air volume device 5*a*, outside air sucked from the air inlet 5*b* passes through a prefilter 5*d* mounted to the outside air filter unit 5*c*, where dust contained in the outside air is removed, and the outside air is fed into the air conditioner 5. Further, air exhausted from a clean room 11 through the return air duct 14 enters the fixed air volume device 5*a*, and is fed into the air conditioner 5 together with the outside air from which the dust has been removed.

Then, the purified air fed into the air conditioner 5 passes through the air duct 13 connected to the air conditioner 5 and is fed into the clean room 11, and thus the air circulates in the unit type clean room 1 with control so that an amount of the purified air fed from the air conditioner 5 through the air duct 13 into the clean room 11 by the fixed air volume device 5*a*, an amount of the outside air sucked from the air inlet 5*b*, and an amount of air in the clean room 11 exhausted from the return air duct 14 are constant.

Figure 10:
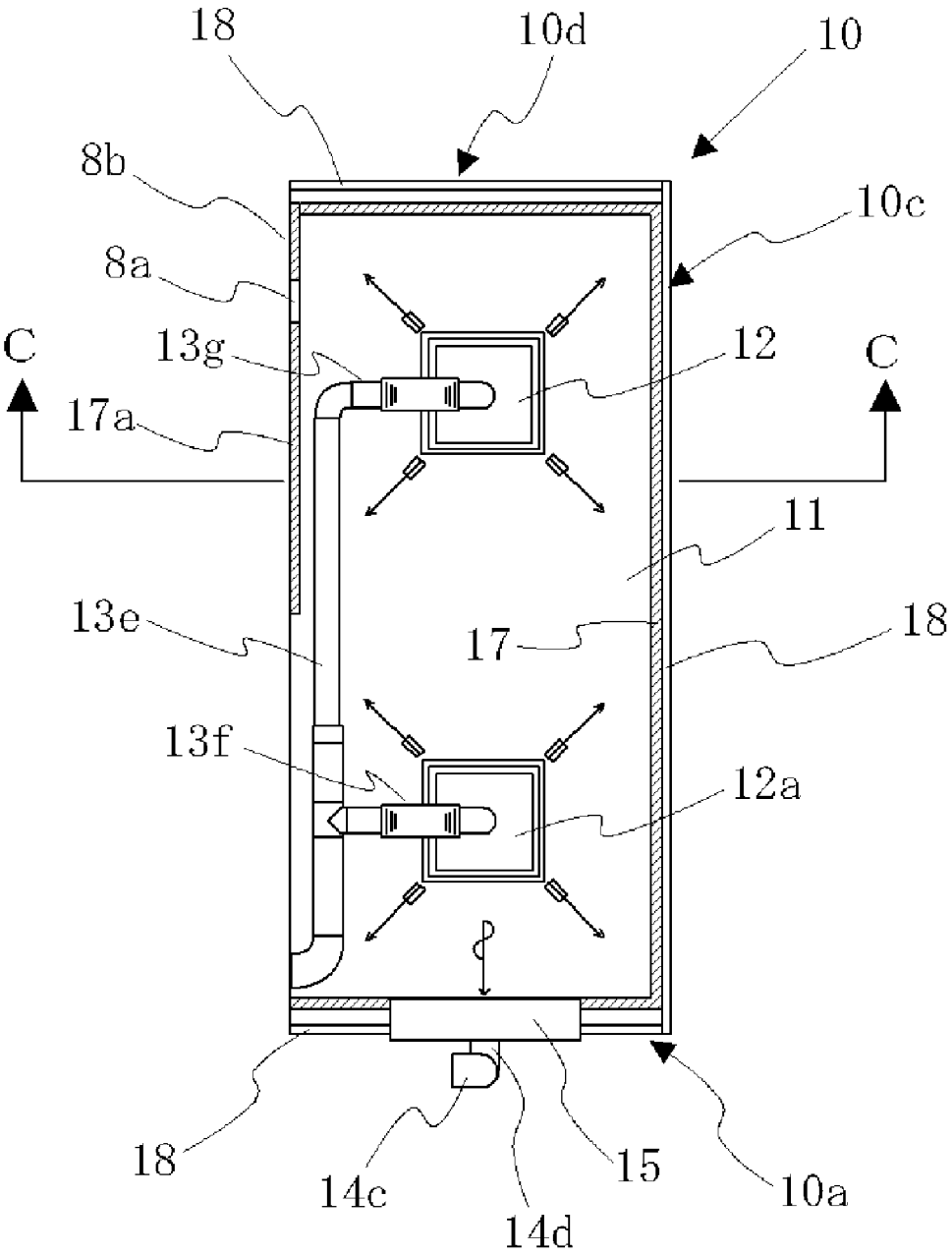
FIG. 10 is a plan view of a clean room unit that constitutes the unit type clean room according to the present invention.
Figure 11:
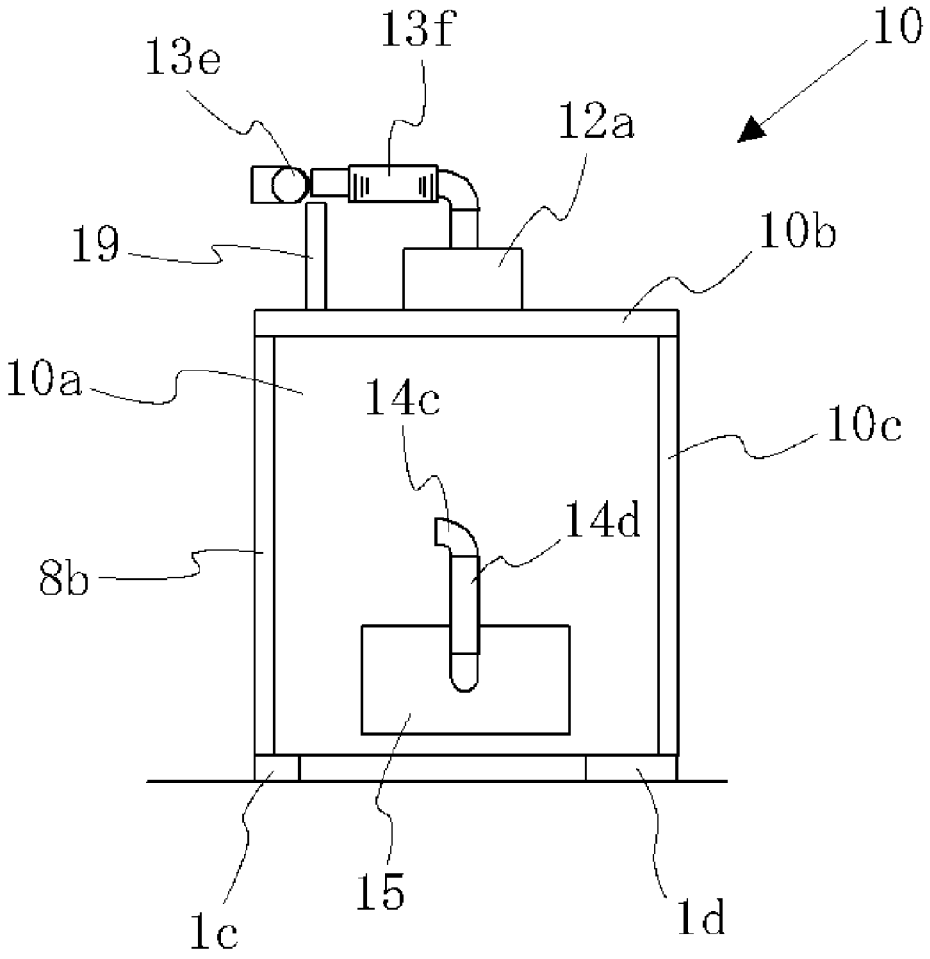
FIG. 11 is a front view of the clean room unit that constitutes the unit type clean room according to the present invention.
Figure 12:
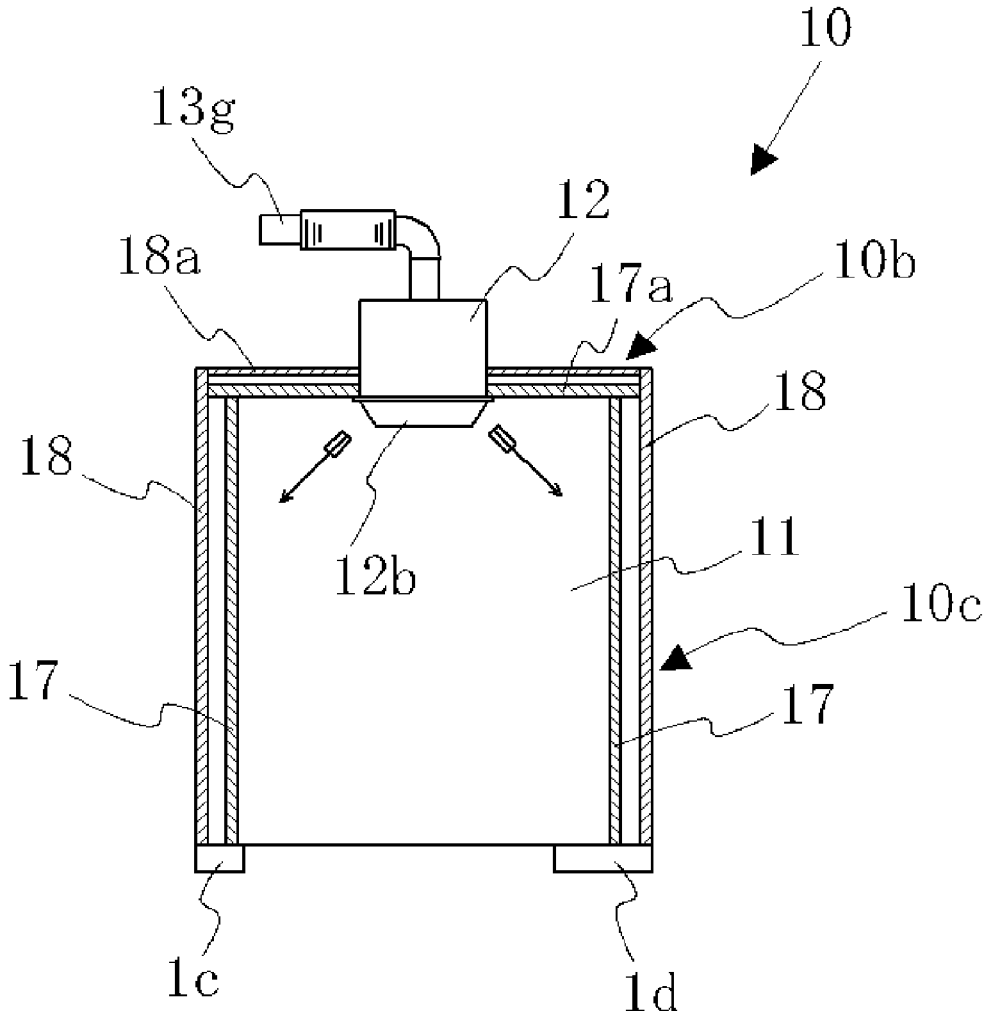
FIG. 12 is a C-C sectional view of the clean room unit that constitutes the unit type clean room according to the present invention.

FIGS. 10 to 12 show the clean room unit that constitutes the unit type clean room according to the present invention. FIG. 10 is a plan view of the clean room unit, FIG. 11 is a front view of the clean room unit, and FIG. 12 is a sectional view of the clean room unit taken along the line C-C in FIG. 10.

As shown in FIGS. 10 to 12, the clean room unit 10 constitutes a rectangular clean room 11 surrounded by a clean room front panel 10*a*, a clean room outer wall panel 10*c*, a clean room back panel 10*d*, the boundary panel 8*b*, and a clean room roof panel 10*b*.

As shown, the clean room front panel 10*a*, the clean room outer wall panel 10*c*, the clean room back panel 10*d*, the boundary panel 8*b*, and the clean room roof panel 10*b* are formed of outer wall materials 18 and 18*a* and insulating panels 17 and 17*a* into a double structure.

Two HEPA filter units 12 and 12*a* are provided on a ceiling portion of the clean room 11, that is, the clean room roof panel 10*b*, and air ducts 13*g* and 13*f* are connected to the HEPA filter units 12 and 12*a*, respectively. The air ducts 13*g* and 13*f* are branch pipes of the air duct 13 connected to the air conditioner 5 installed in the machine room unit 2.

As shown in FIGS. 10 and 11, a return air chamber 15 is embedded in a front lower portion of the clean room unit 10, that is, a lower portion of the clean room front panel 10*a*. A rear end 14*d* of the return air duct 14 is connected to the return air chamber 15.

The purified air fed from the air conditioner 5 installed in the machine room unit 2 through the air duct 13 is fed through the air duct 13*e* to the branch pipes 13*f* and 13*g* and into the HEPA filter units 12 and 12*a*. In the HEPA filter units 12 and 12*a*, the purified air passes through HEPA filters and is further purified and fed into the clean room 11.

Then, the purified air in the clean room 11 is exhausted from the return air chamber 15 into the return air duct 14 and fed into the fixed air volume device 5*a* installed in the machine room unit 2, and thus the air in the clean room 11 always circulates.

Since the clean room 11 is an operation space, for use of a wider space, the clean room 11 includes no components other than the HEPA filter units 12 and 12*a* and the return air chamber 15 provided on the ceiling (clean room roof panel 10*b*) and the clean room front panel 10*a*, respectively, thereby maintaining a wide operation space.

Figure 13:
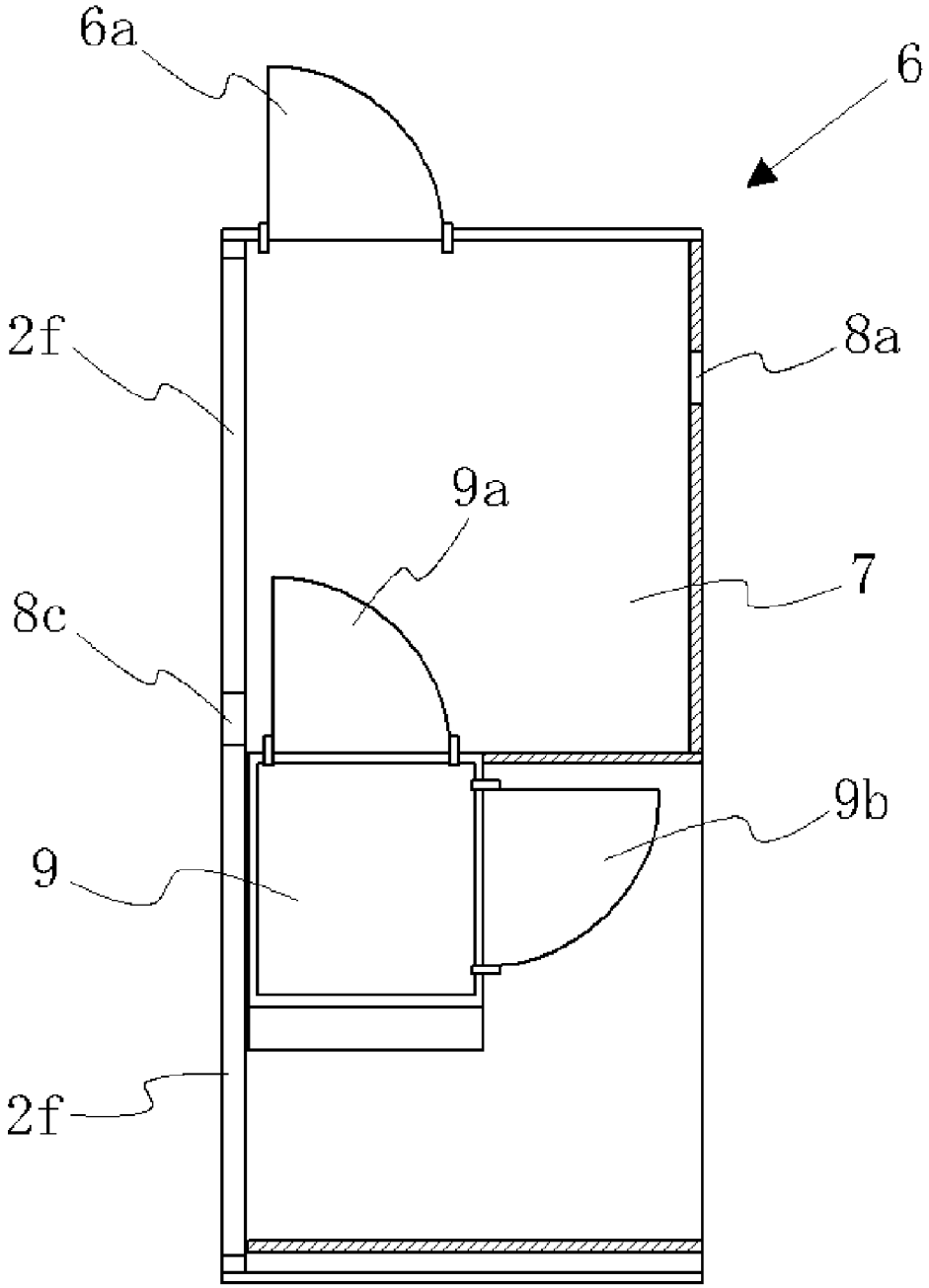
FIG. 13 is a plan view of a front room unit that constitutes the unit type clean room according to the present invention.
Figure 14:
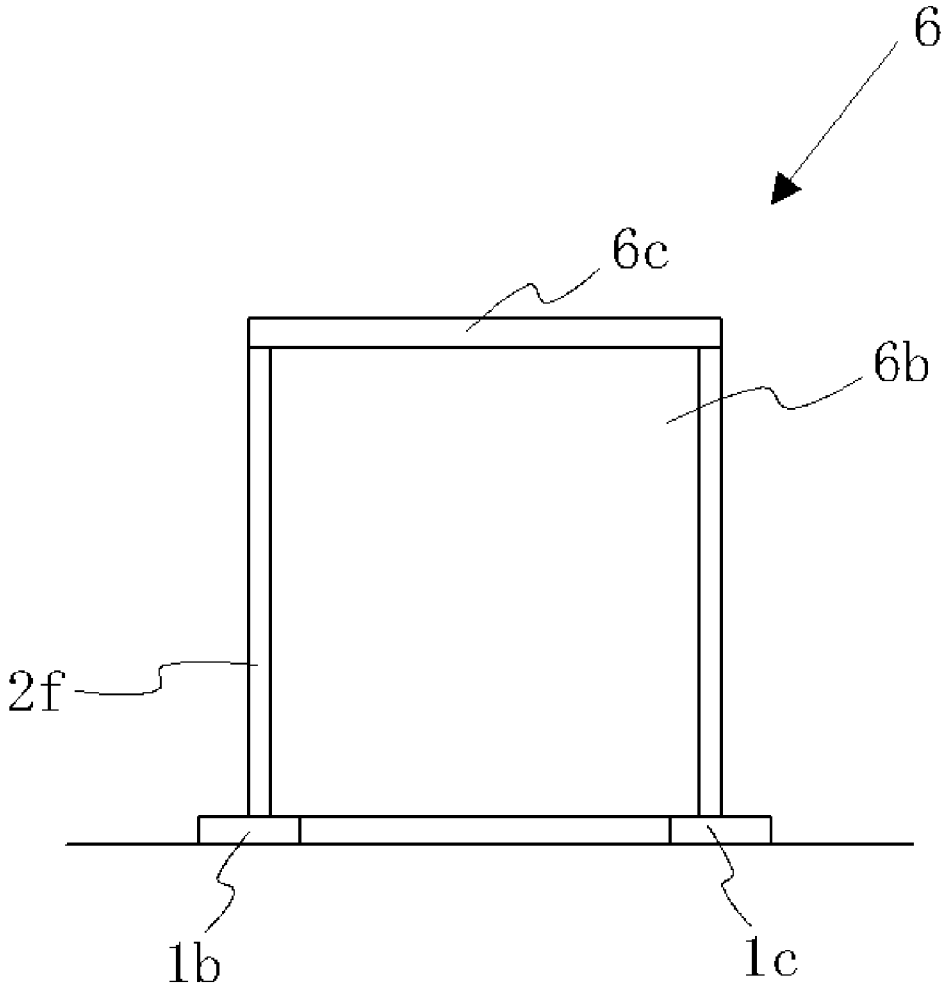
FIG. 14 is a front view of the front room unit that constitutes the unit type clean room according to the present invention.
Figure 15:
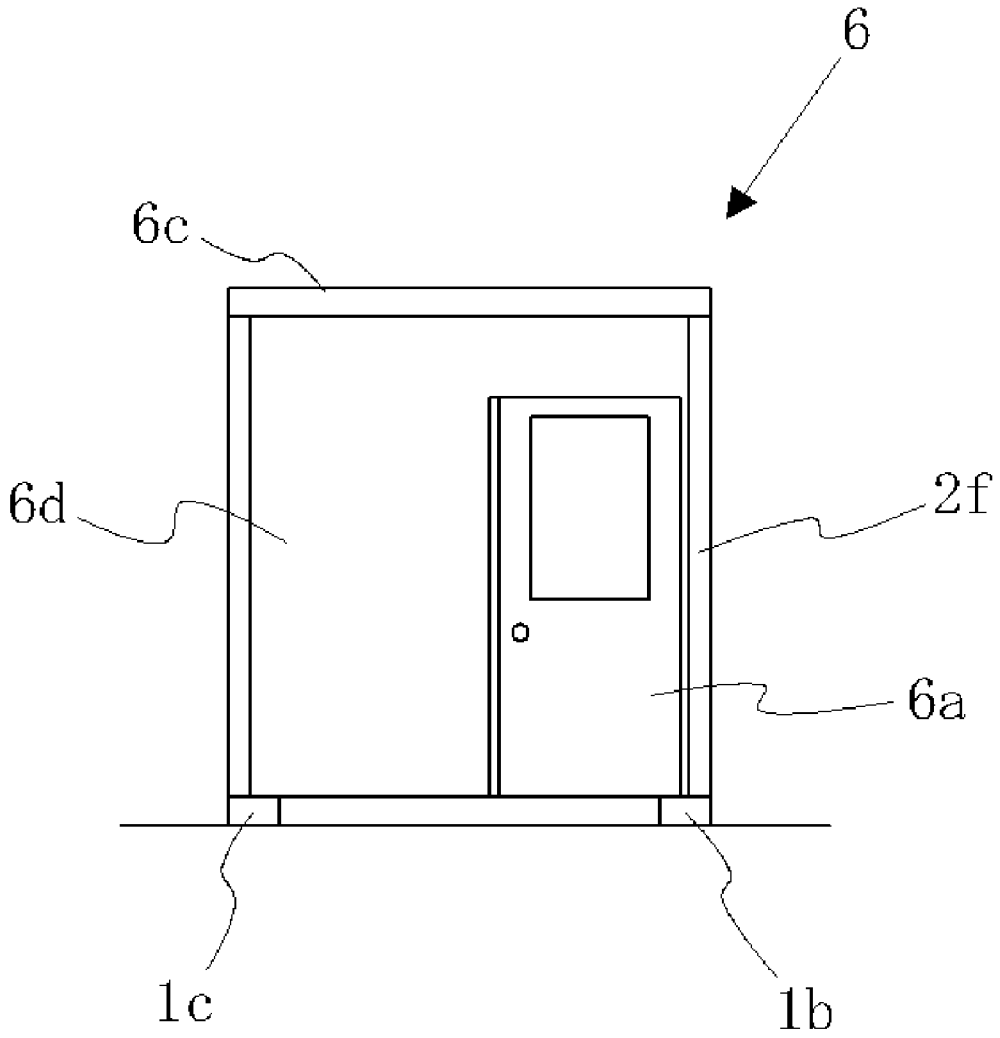
FIG. 15 is a back view of the front room unit that constitutes the unit type clean room according to the present invention.

FIGS. 13 to 15 show the front room unit that constitutes the unit type clean room according to the present invention. FIG. 13 is a plan view of the front room unit, FIG. 14 is a front view of the front room unit, and FIG. 15 is a back view of the front room unit.

As shown in FIGS. 13 to 15, the front room unit 6 is a room surrounded by a front room front panel 6*b*, a front room roof panel 6*c*, a front room back panel 6*d*, and the boundary panel 2*f*, and constitutes a front room 7 and an air shower 9. The front room 7 is located inside a front room inlet door 6*a* provided in the front room back panel 6*d*, and a door of an air shower inlet 9*a* into the air shower 9 is provided in front of the front room inlet door 6*a*.

The air shower 9 is a substantially square small space, and a door of an air shower exit 9*b* is provided immediately on the left inside the air shower inlet 9*a*.

Figure 16:
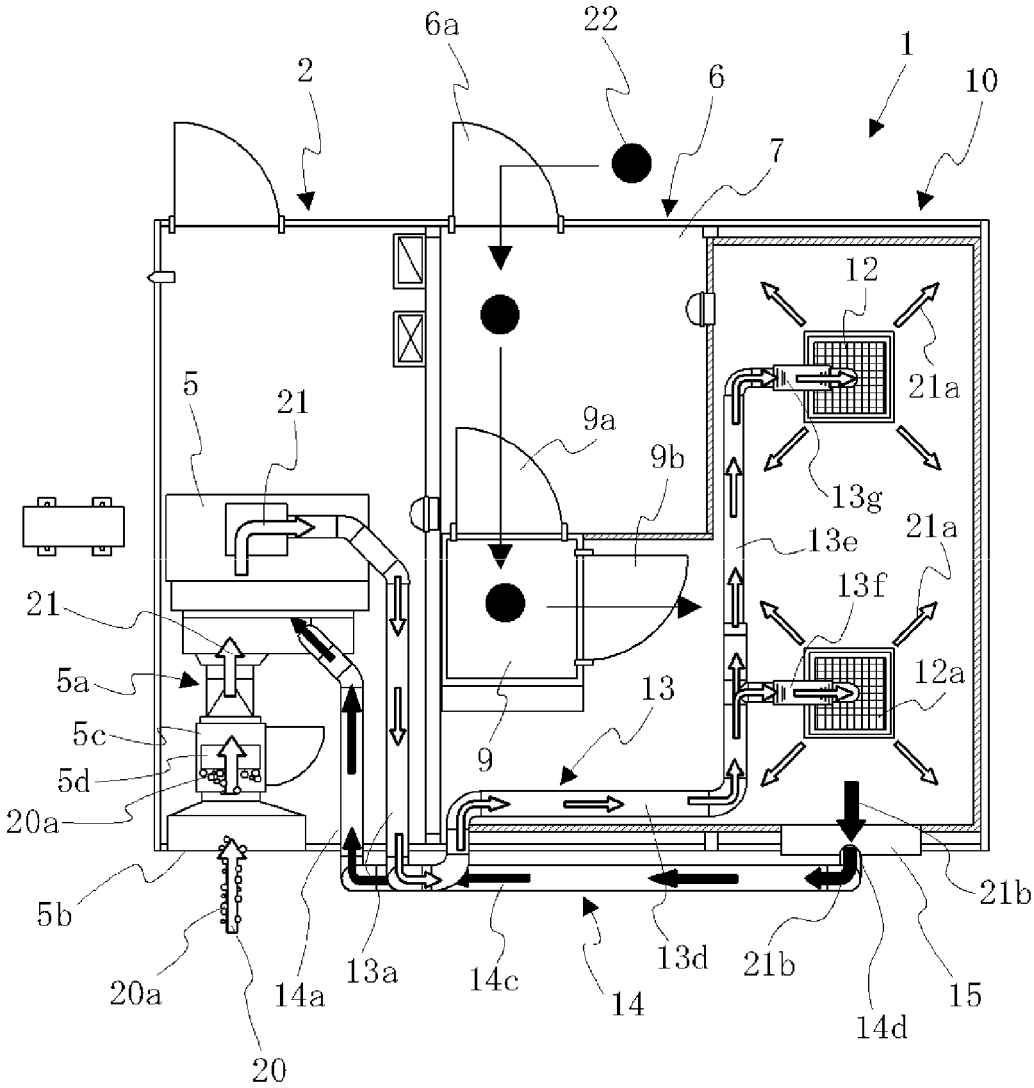
FIG. 16 shows air circulation in the unit type clean room according to the present invention.

Next, with reference to FIG. 16, air circulation and entering of an operator in and into the unit type clean room according to the present invention will be described. FIG. 16 is a plan view showing air circulation in the unit type clean room according to the present invention. Arrows denoted by reference numerals 20, 21, 21*a* and 21*b* show a flow of air, and black circles and arrows denoted by reference numeral 22 show movement of the operator.

The unit type clean room according to the present invention 1 first sucks outside air 20 from the air inlet 5*b* provided in the machine room front panel 2*b* of the machine room unit 2 into the fixed air volume device 5*a*. At this time, the outside air 20 contains dust 20*a*.

The outside air 20 sucked into the fixed air volume device 5*a* passes through the outside air filter unit 5*c*. The prefilter 5*d* is mounted to the outside air filter unit 5*c*, and thus the outside air passes through the outside air filter unit 5*c*, where the dust 20*a* is removed, and is fed into the air conditioner 5 as purified air 21.

Then, the purified air 21 is fed from a front end 13*a* of the air duct 13 connected to the air conditioner 5 into the air duct 13 and flows through the arranged air ducts 13*b*, 13*c* and 13*d*. The branch pipes 13*f* and 13*g* of the air duct 13 are connected to the upper portions of the two HEPA filter units 12 and 12*a* embedded in the clean room roof panel 10*b* of the clean room unit 10, and thus the purified air 21 is fed through the branch pipe 13*f* into the HEPA filter unit 12*a*, and further flows through the air duct 13*e* and is fed through the branch pipe 13*g* into the HEPA filter unit 12.

The purified air 21 flowing through the air duct 13 and fed through the branch pipes 13*f* and 13*g* into the HEPA filter units 12 and 12*a* passes through the HEPA filters mounted to the HEPA filter units 12 and 12*a*, where finer dust 20*a* is removed, and is exhausted into the clean room 11 as very clean purified air 21*a*.

The purified air 21*a* exhausted into the clean room 11 is exhausted from the inside of the clean room 11 into the return air duct 14 by the return air chamber 15 embedded in the clean room front panel 10*a*. Exhaust air 21*b* exhausted from the return air chamber 15 into the return air duct 14 flows through the return air ducts 14, 14*b* and 14*c*, and is exhausted into the fixed air volume device 5*a* installed in the machine room unit 2 to which a front end 14*a* of the return air duct 14 is connected.

The exhaust air 21*b* exhausted into the fixed air volume device 5*a* meets the purified air 21 that is the outside air 20 sucked from the air inlet 5*b* and purified with the dust 20*a* removed, and flows into the air conditioner 5 and the air duct 13. Thus, purified air always circulates in the unit type clean room 1 according to the present invention.

The operator 22 who operates in the clean room 11 first enters the front room 7 through the front room inlet door 6*a*, goes to the air shower inlet 9*a* to enter the air shower 9 provided in the back of the front room 7, and enters the air shower 9.

The operator 22 takes the air shower 9 and remove the dust 20*a* adhering to his/her body and clothes. Then, the operator 22 enters the clean room 11 through the air shower exit 9*b*. Thus, the operator 22 who enters the clean room 11 can enter the clean room 11 in a clean state without any dust 20*a* adhering to his/her body and clothes.

Figure 17:
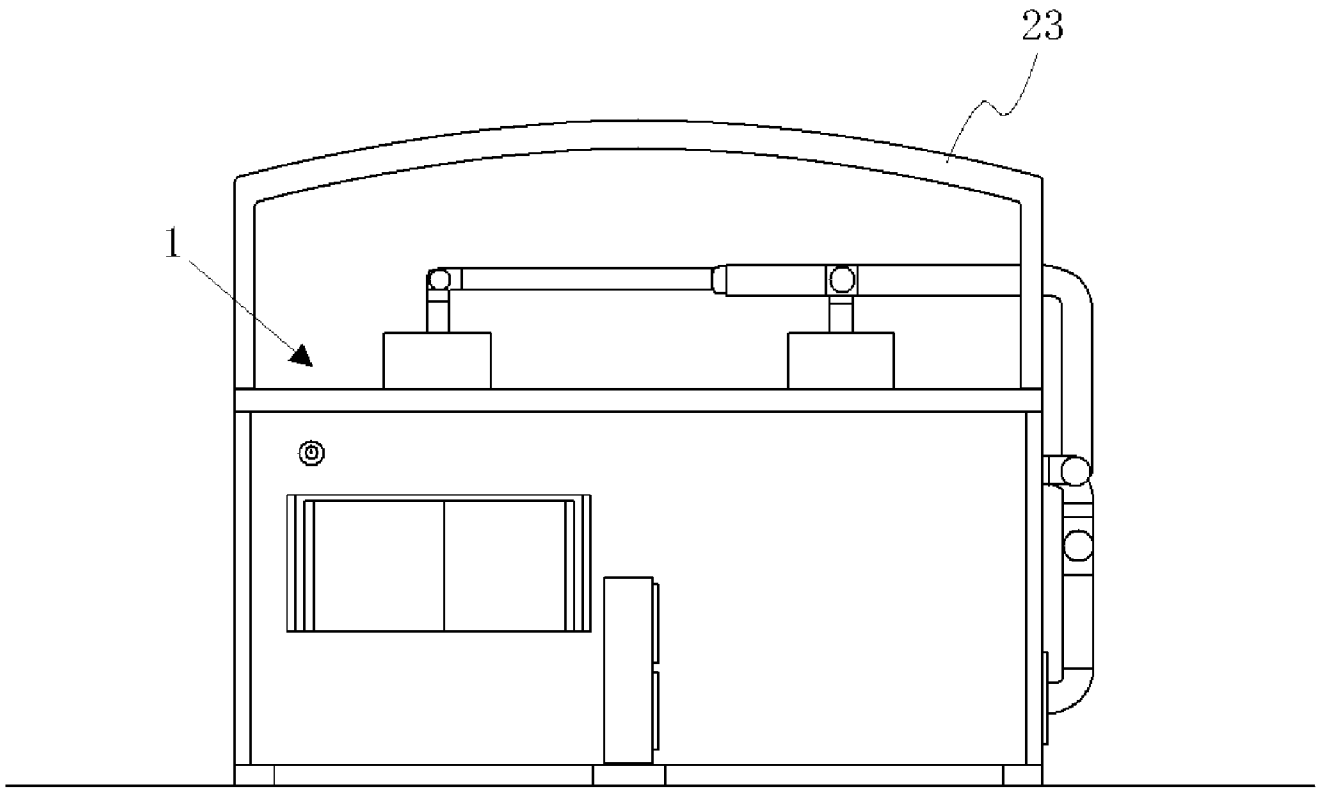
FIG. 17 shows a second embodiment of a unit type clean room according to the present invention.

FIG. 17 shows a second embodiment of a unit type clean room according to the present invention. As shown in FIG. 17, a roof cover 23 can be mounted to the unit type clean room 1 according to the present invention.

In the unit type clean room 1 according to the present invention, the machine room unit 2, the front room unit 6, and the clean room unit 10 are assembled, and then the air duct 13 and the return air duct 14 are arranged. Thus, a framework is installed on a roof portion and the roof cover 23 is placed over the roof portion before the air duct 13 and the return air duct 14 are arranged, thereby allowing the roof cover 23 to be mounted in any directions.

INDUSTRIAL APPLICABILITY

The present invention provides a unit type clean room that can always retain clean air in the clean room having a wide operation space, is unitized and can be easily installed without large equipment, thus can be freely increased or decreased in floor area, and can freely combine units that constitute the clean room.

The invention claimed is:

1. A unit type clean room, comprising:

a machine room unit having flooring, a front panel standing on said flooring and provided with an air inlet for intake of air to be fed into the clean room, a boundary panel located on a side adjacent to a front room and including a power board and a control board for operating the unit type clean room and a differential pressure damper for adjusting air pressure with respect to the front room, an outer wall panel facing said boundary panel, a back panel facing said front panel and provided with a machine room inlet door, and a ceiling panel placed on upper portions of said panels and over which a roof panel is placed, an outside air filter unit connected to said air inlet and including a prefilter, a fixed air volume device connected to said outside air filter unit, and an air conditioner connected to said fixed air volume device and to which a front end of an air duct that feeds purified air into a clean room protrudes outwardly from said front panel and a front end of a return air duct through which exhaust air from the clean room passes is connected;

a clean room unit having flooring, a front panel formed with an insulating material on an inner side and an outer wall material on an outer side standing on said flooring and provided with a return air chamber connected to a rear end of the return air duct, an outer wall panel formed with an insulating material on an inner side and an outer wall material on an outer side and located on a side facing said machine room unit, a back panel facing said front panel, and a roof panel placed on upper portions of said panels, formed with an insulating material on an inner side and an outer wall material on an outer side, and on which an HEPA filter unit is connected to a rear end of said air duct, said clean room unit forming a clean room space;

a front room unit that is located between said machine room unit and said clean room unit, having flooring, a front panel standing on said flooring, a back panel facing said front panel and provided with an inlet door of said front room, a boundary panel that has an insulating panel extending to a side surface facing the outer wall panel of said clean room unit and includes a differential pressure damper for adjusting air pressure with respect to said clean room, and an insulating panel placed on upper portions of said panels and over which a roof panel is placed, and that includes a partitioned air shower room that is connected to a partition connected to the insulating panel on a side of the said clean room unit, said air shower room dividing said front room unit into a front room and an open space that constitutes a part of the clean room and having is provided with an inlet on a side of said front room and an outlet on a side of said open space, and removing dust before entering said clean room.

2. The unit type clean room according to claim 1, wherein said machine room unit, said clean room unit, and said front room unit are assembled, a framework is installed on a roof portion, a roof cover is placed over the roof portion, and said air duct and said return air duct are connected below said roof cover.

* * * * *